US005513706A

United States Patent [19]

Jennings, Jr. et al.

[11] Patent Number: 5,513,706

[45] Date of Patent: May 7, 1996

[54] METHOD FOR IMPROVING FORMATION STABILITY SURROUNDING A DEVIATED WELLBORE

[75] Inventors: Alfred R. Jennings, Jr., Plano; E. Thomas Strom, Dallas, both of Tex.

[73] Assignee: Mobil Oil Corporation, Fairfax, Va.

[21] Appl. No.: 436,899

[22] Filed: May 8, 1995

[51] Int. Cl.[6] ..... E21B 7/04; E21B 33/138; E21B 43/04

[52] U.S. Cl. ..... 166/285; 166/50; 175/61

[58] Field of Search ..... 166/285, 29, 295, 166/50, 276; 175/61, 62

[56] References Cited

U.S. PATENT DOCUMENTS 3,088,520 5/1963 Hildebrandt ..... 166/295
3,367,420 2/1968 Jennings et al. ..... 166/276
4,733,729 3/1988 Copeland ..... 166/276
5,095,987 3/1992 Weaver et al. ..... 166/295 X
5,332,037 7/1994 Schmidt et al. ..... 166/295 X

*Primary Examiner*—Stephen J. Novosad
*Attorney, Agent, or Firm*—Alexander J. McKillop; George W. Hager, Jr.

[57] ABSTRACT

Formation stability surrounding a deviated wellbore penetrating a hydrocarbon reservoir is improved by alternately injecting higher and lower density consolidating materials, the higher density material improving stability in the formation primarily on the low side of the wellbore and the lower density material improving stability in the formation primarily on the high side of the wellbore.

6 Claims, 1 Drawing Sheet

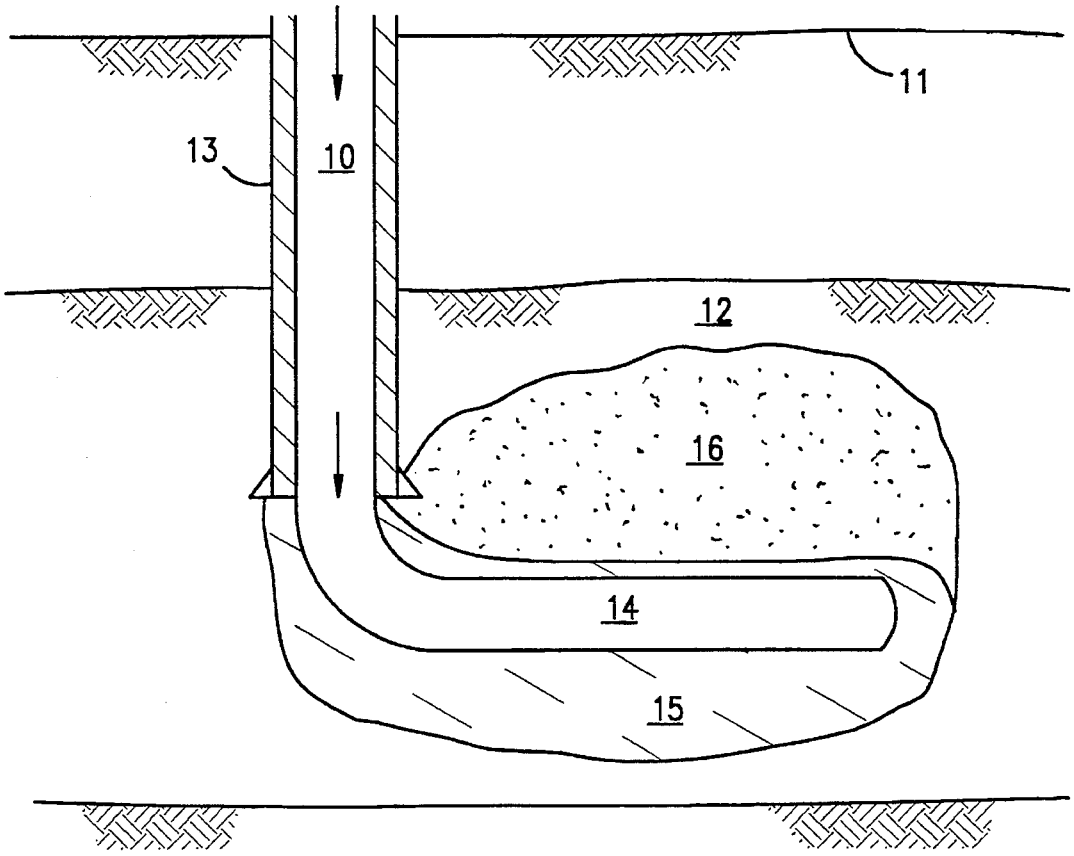
11
13
10
12
16
14
15

METHOD FOR IMPROVING FORMATION STABILITY SURROUNDING A DEVIATED WELLBORE

BACKGROUND OF THE INVENTION

Deviated wellbores, particularly horizontal wellbores, drilled into oil and gas reservoirs have proven to be effective in increasing the productive capacity and reservoir drainages from such reservoirs. Horizontal wellbores have been drilled and completed in carbonates and sandstones and in virtually any type of formation that contains producible hydrocarbons. Since the horizontal section of a wellbore may extend for several thousands of feet into the formation, one of the primary concerns during drilling, completion, and production is wellbore stability.

In horizontal wellbores, wellbore stability is necessary to allow the hole to be drilled and drillpipe and bit tripped in and out of the wellbore. After drilling, the wellbore must remain open to allow the completion equipment to be run into the wellbore (liners for cementing and perforating, slotted liners, pre-packed screens, etc.). After the horizontal section has been completed, it is necessary for the wellbore to remain stable during the production phases to prevent casing collapse, plugging of perforations or slots or slotted liners, etc.

Therefore, what is needed in loosely consolidated formations is a means of stabilizing wellbores to allow drilling and completion of horizontal wellbores in loosely consolidated formations with sustained productibility thereafter.

SUMMARY OF THE INVENTION

In accordance with the present invention a method is provided for improving formation stability surrounding a deviated wellbore, particularly horizontal, wherein a higher density formation consolidating material is initially injected into a formation surrounding the wellbore to stabilize the near wellbore area primarily on the low side of the wellbore and thereafter a lower density formation consolidating material is injected into the formation to stabilize the near wellbore area primarily in the high side of the wellbore. The higher and lower density consolidating materials may be alternately injected during the drilling of the deviated wellbore. In a further aspect, the higher and lower density consolidating materials may be periodically injected during the drilling of the deviated wellbore. In a still further aspect, the higher and lower density consolidating materials may be included in drilling fluid utilized during drilling of the deviated wellbore.

In a yet further aspect, the higher density consolidating material has a density preferably in the range of 9 to 12 pounds per gallon and the lower density consolidating material has a density preferably in the range of 0.24 to 0.50 pounds per gallon less than the density of the higher density material.

BRIEF DESCRIPTION OF THE DRAWING

The drawing is a pictorial schematic of a deviated wellbore being treated by the method of the present invention to improve wellbore stability.

DESCRIPTION OF THE PREFERRED EMBODIMENT

For a description of the wellbore stabilizing method of the present invention, reference is made to the drawing where there is shown a wellbore 10 which extends from the surface of the earth 11 and penetrates a subterranean hydrocarbon reservoir 12 which is to be produced. The wellbore is deviated during drilling within the hydrocarbon reservoir as illustrated by the horizontal section 14.

In carrying out the method of the present invention, an initial stage comprises the downhole injection (as shown by the arrows) of a consolidating material (i.e. certain silicates, resins, etc.) having a higher density preferably in the range of 9 to 12 pounds per gallon. This consolidating material invades the reservoir 12 to improve stability of the near wellbore area 15 primarily on the low side of the wellbore. Thereafter, in a second stage, a consolidating material having a lower density preferably in the range of 0.25 to 0.50 pounds per gallon less than the higher density fluid is injected downhole whereby it overrides the higher density consolidating material after it has "set up" so as to invade the reservoir 12 to improve stability of the near wellbore area 16 primarily on the high side of the wellbore. The amount of consolidating material injected during each stage can be designed based on the desired amounts of the reservoir to be consolidated on the high and low sides of the deviated wellbore.

Attempts to apply conventional sand consolidation techniques in highly deviated and horizontal wellbores will result in the lower side of the wellbore receiving a major part of the treatment due to the weight of fluid and the effects of gravity acting upon it. In order to effectively consolidate the high side of the horizontal wellbore (where wellbore collapse is actually most likely to occur), it is necessary to pump a second fluid, lower in density than the first, to ride up over the first material in place. While the initial, heavier fluid begins to "set up", the second lighter fluid will travel to the upper part of the wellbore area prior to setting.

The higher and lower density consolidating materials could be placed in the reservoir by means of alternate and/or periodic injections during drilling, or could be incorporated as part of the drilling fluid during the drilling of the deviated wellbore. The method could be modified for several applications depending upon reservoir characteristics, length of the horizontal section of the wellbore, insitu stresses, depth, temperature, type of production, etc.

What is claimed is:

1. A method for improving formation stability surrounding a deviated wellbore, comprising the steps of:

a) injecting a higher density formation consolidating material into the formation surrounding said deviated wellbore to stabilize the near wellbore area primarily on the low side of the wellbore, and b) injecting a lower density formation consolidating material into the formation surrounding said deviated wellbore to stabilize the near wellbore primarily on the high side of the wellbore.

2. The method of claim 1 wherein:

a) said higher density consolidating material has a density in the range of 9.0 to 12.0 pounds per gallon, and b) said lower density consolidating material has a density in the range of 0.25 to 0.5 pounds per gallon less than the higher density fluid.

3. The method of claim 1 wherein said deviated wellbore is a horizontal wellbore.

4. The method of claim 1 wherein said higher and lower density consolidating materials are alternately injected into said formation during drilling of said deviated wellbore.

5. The method of claim 4 wherein said higher and lower density consolidating materials are periodically injected into said formation during drilling of said deviated wellbore.

6. The method of claim 1 wherein said higher and lower density consolidating materials are included in drilling fluid utilized during drilling of said deviated wellbore.

* * * * *